United States Patent [19]

Tye

[11] Patent Number: 4,554,424

[45] Date of Patent: Nov. 19, 1985

[54] ELECTRICAL SWITCH

[75] Inventor: Ronald G. Tye, Bishops Stortford, England

[73] Assignee: Minnesota Mining and Manufacturing Co., St. Paul, Minn.

[21] Appl. No.: 614,284

[22] Filed: May 25, 1984

[30] Foreign Application Priority Data

May 27, 1983 [GB] United Kingdom ..... 8314801

[51] Int. Cl.[4] ..... H01H 3/02; H01H 9/02

[52] U.S. Cl. ..... 200/86 R; 200/300

[58] Field of Search ..... 200/52 R, 61.08, 61.19, 200/61.5, 61.93, 85 R, 86 R, 86 A, 86.5, 153 M, 237, 238, 276, 300

[56] References Cited

U.S. PATENT DOCUMENTS

| | | | |
|---|---|---|---|
| 617,938 | 1/1899 | Risley | 200/86 R |
| 683,657 | 10/1901 | Noreen | 200/86 R |
| 1,029,675 | 6/1912 | Erlach | 200/86 R |
| 1,775,755 | 9/1930 | Forman | 200/86 R |
| 1,891,751 | 12/1932 | Coyne | 200/86 R |
| 2,766,358 | 10/1956 | Davidson | 200/300 |
| 2,951,921 | 9/1960 | Wikkerink | 200/86 R |
| 3,722,086 | 3/1973 | Wikkerink et al. | 29/622 |
| 3,735,072 | 5/1973 | Six, Jr. | 200/61.5 X |
| 3,812,313 | 5/1974 | Wolf et al. | 200/86 R |
| 3,825,277 | 7/1974 | Steinback | 200/86 R |
| 4,037,069 | 7/1977 | Gonzalez et al. | 200/86 R |
| 4,105,899 | 8/1978 | Velosa | 307/115 |

FOREIGN PATENT DOCUMENTS

| | | |
|---|---|---|
| 39491 | 11/1981 | European Pat. Off. . |
| 2148760 | 4/1973 | Fed. Rep. of Germany . |
| 1416570 | 9/1965 | France . |
| 2431178 | 8/1980 | France . |
| 392936 | 6/1933 | United Kingdom . |
| 693605 | 6/1953 | United Kingdom . |
| 716504 | 10/1954 | United Kingdom . |
| 820453 | 9/1959 | United Kingdom . |
| 916030 | 1/1963 | United Kingdom . |
| 1183936 | 3/1970 | United Kingdom . |
| 1185862 | 3/1970 | United Kingdom . |
| 1209564 | 10/1970 | United Kingdom . |
| 1283895 | 8/1972 | United Kingdom . |
| 1358006 | 6/1974 | United Kingdom . |
| 1369174 | 10/1974 | United Kingdom . |
| 1386423 | 3/1975 | United Kingdom . |
| 1454805 | 11/1976 | United Kingdom . |
| 2064222 | 6/1981 | United Kingdom . |
| 2083858A | 3/1982 | United Kingdom . |
| 2128031 | 4/1984 | United Kingdom . |
| 2088637 | 8/1984 | United Kingdom . |

*Primary Examiner*—J. R. Scott

*Attorney, Agent, or Firm*—Donald M. Sell; James A. Smith; Richard Francis

[57] ABSTRACT

A normally-open pressure actuatable switchmat comprising first and second electrically conductive members separated by non-conductive material having a failsafe safety switch is provided. When the switchmat is subjected to an actuation load, there is relative movement between the first and second electrically conductive members to complete an electrically conductive path therebetween. The safety switch comprises a bridging member which includes an electrically conductive spring which is held in a compressed state by frangible restraining element such that, when the switchmat is subjected to a predetermined minimum overload, the frangible restraining element is broken allowing the spring to relax thereby completing an electrically conductive path between the conductive members. This path is maintained after removal of the overload thereby allowing the switchmat to failsafe.

14 Claims, 20 Drawing Figures

Fig. 1.
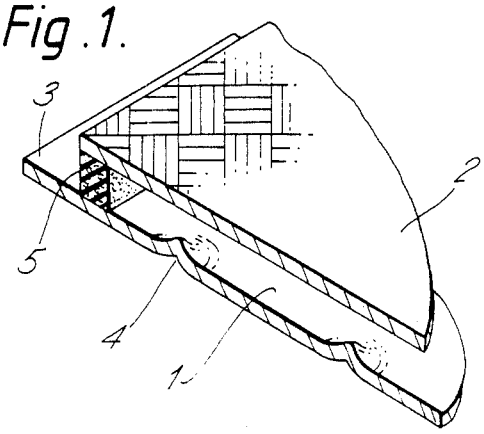
Fig. 3.
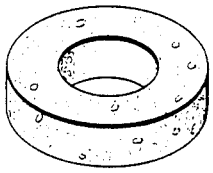
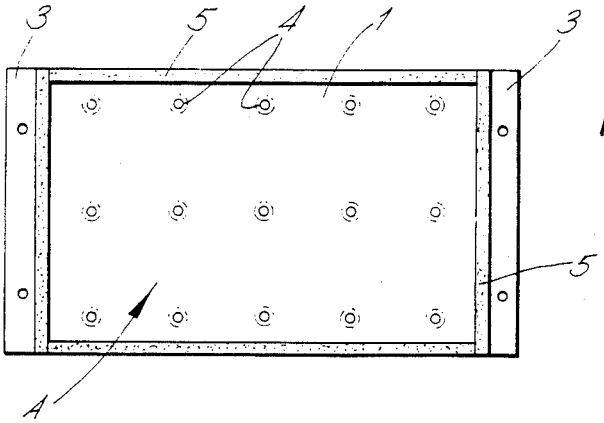
Fig. 2.
Fig. 5.
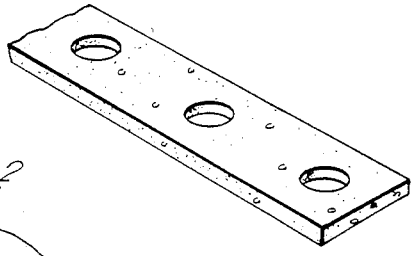
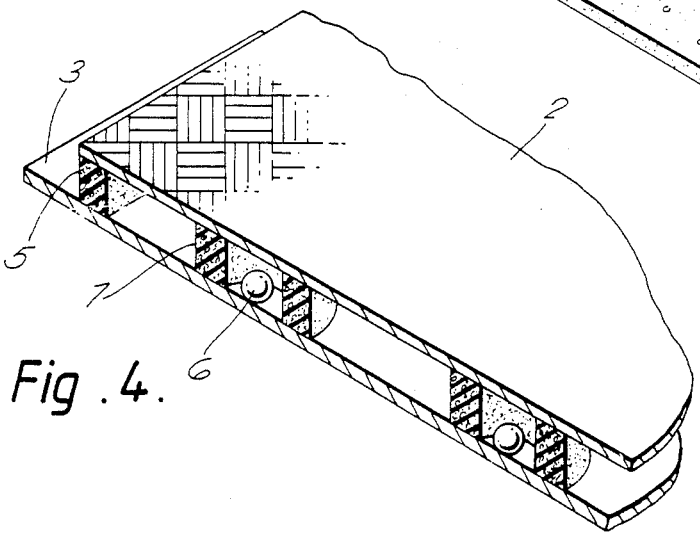
Fig. 4.

ELECTRICAL SWITCH

This invention relates to an electrical switch and in particular to an electrical switch which is activated by a predetermined load and when activated, completes an electrically conductive path which cannot subsequently be broken without dismantling the switch. More particularly, the invention relates to a pressure-sensitive switchmat incorporating such an electrical switch as a safety device.

TECHNICAL FIELD

This invention relates to an electrical switch, pressure-sensitive switchmat incorporating such an electrical switch, and a bridging device useful therewith as a safety device.

BACKGROUND ART

Load sensitive mats incorporating electrical switches are well known and are generally referred to as "switchmats". For example, switchmats are conventionally located adjacent to entry doors of buildings such as supermarkets, airports and other public places so as to lie in the path of pedestrians approaching doors. A pedestrian stepping upon the mat would close a normally open switch contained in the mat to actuate a mechanism, for example, for opening the door automatically. Switchmats are also used in industrial environments to limit access to dangerous machinery or control the operation of machinery. In particular, a switchmat may be employed to actuate a safety circuit preventing operation of a machine when a person enters a dangerous zone.

Examples of known pressure-sensitive switches and switchmats are disclosed in British Pat. Nos. 392 936, 1 185 862, 1 209 564, 1 351 911, 1 358 006, 1 369 174, 1 454 805, 2 064 222, 2 083 858 and 2 088 637, U.S. Pat. Nos. 1,775,755, 2,951,921, 3,722,086, 3,812,313, 3,828,277, 4,037,069 and 4,105,899, French Pat. Nos. 1 416 570 and 2 431 178 and German Offenlegungsschrift No. 2 148 760.

Switchmats generally comprise first and second electrically conductive members, which are normally planar, separated by non-conductive material and optionally include one or more intermediate conductive elements positioned between the first and second conductive members. The switchmat is normally constructed without a conductive path between the first and second electrically conductive members to provide an open electrical circuit. The switchmat is subjected to load, when the electrically conductive members are caused to come into electrical contact with each other, to provide a closed electrical circuit. Such contact is established by compression of the non-conductive material and/or bowing of one or both of the electrically conductive members, such that a conductive path is established between the electrically conductive members, optionally via intermediate conductive elements. When the load is removed, the electrically conductive members return to their spaced position.

Switchmats are not sufficiently durable to withstand use in an industrial environment for long periods of time. The switchmats used in industry may be subjected to severe overloads, e.g. the dropping of a heavy object or passage of a hand cart or truck. Such physical abuse of a switchmat may result in the complete failure of its switch mechanism. A need exists for a "failsafe" switchmat which will be rendered inoperative, with the switch permanently in the closed position, by providing a permanent conductive path between the conductive elements to complete an electrical circuit, when its switch mechanism is damaged.

DISCLOSURE OF INVENTION

The present invention provides a switchmat with a failsafe safety switch.

Therefore according the invention there is provided an improved pressure actuatable switchmat comprising first and second electrically conductive members separated by non-conductive material constructed and arranged such that, when the switchmat is subjected to an actuation load, the electrically conductive members complete an electrically conductive path therebetween, optionally via intermediate electrical conductive elements. The improvement in the switchmat includes an overload switch comprising a electrically conductive bridging member having a first end and a second end separated by an electrically conductive spring member which is held in a compressed state by frangible restraining means. When the switchmat is subjected to a predetermined minimum overload, the frangible restraining means is broken, releasing the spring to its relaxed mode, and causing at least one of the ends to move, thereby completing an electrically conductive path between the first and second electrically conductive members which path is maintained after removal of said overload.

The invention also provides a safety switch comprised of electrically separated conductors and the restrained bridging means suitable for use in a switchmat which is of simple construction and low cost. The switch is activated by a predetermined load being exerted upon the restraining means, causing the restraining means to break, thereby permitting the bridging member to spring across the gap between the two electrical conductors so completing an electrical circuit. The switching action cannot be reversed without dismantling the device and accordingly the switch is particularly suitable as a failsafe device. The switch may be constructed in such a fashion that dismantling will not be practical at the site of use thereby preventing interference with the circuitry by unauthorised persons.

The bridging member may take any desired form providing that, when the restraining means is broken, the bridging member will spring from its compressed state towards its relaxed mode to complete a path between the conductors.

While the bridging member may be compressed by the restraining means against one of the electrical conductors, it is preferred to have the restraining means as the sole mechanism for compression of the bridging member.

The bridging member may comprise one or more turns of a helical spring which may be held in a compressed state by a sleeve, collar or loop of restraining means compressing the turns together. In practice, it has been found that 1.3 turn of a helical spring, having the overlapping portions compressed together by a sleeve or bead of frangible material, provides an effective bridging member, particularly when each end of the spring wire is bent respectively up and down to be at right angles to the plane of the contact surface of the conductors. It is desirable that the ends of the bridging member, which are intended to contact the surface of the conductors, be pointed in order to penetrate any oxide or dirt which may form upon the conductor surface. It will readily be appreciated that the bridging member can take many other forms, such as a simple U-shape or other shape shown in the drawings.

The restraining means may comprise a collar or bead of frangible material, e.g. glass, ceramics or brittle plastics material, e.g. Bakelite. The restraining means secures the bridging member in a compressed or restrained state until it is broken by application thereto of a load greater than its breaking strength.

The preferred switchmat in accordance with the invention has a normally open switch which is closed under a predetermined minimum load. The switchmat comprises a first conductive metal sheet separated from a load-bearing metal sheet having an electrically conducting surface by resiliently compressible, non-conductive material, and a plurality of intermediate elements positioned between the sheet such that when at least the predetermined minimum load is applied to the load-bearing sheet, the non-conductive material compresses and one or more of the intermediate elements establishes a conductive path between the sheets, the load bearing sheet being substantially rigid under the intended operating load of the switchmat and the intermediate elements being constructed and arranged such that, when the load bearing metal sheet is subjected to substantial overload, it is supported by the bridging elements thereby preventing damage to the non-conductive material. Such a switchmat additionally comprises a safety switch in accordance with the invention.

DETAILED DESCRIPTION

In its simplest form such a switchmat consists of two semi-rigid metal sheets, at least one of which is load-bearing, separated by an insulating elastomer, e.g. by strips of elastomer positioned around the perimeter of the sheets, each metal sheet being connected to part of an electrical circuit. The switchmat may also include conductive intermediate elements positioned between the metal plates such that, when the elastomer is compressed, a conductive path between the metal sheets is established by the bridging elements. By suitable selection and positioning of the intermediate elements and the elastomers, that mat may be constructed to operate under a predetermined minimum load. For example, for detecting the presence of pedestrians, the mat should be sensitive to a pressure of about 0.44 kg/cm$^2$, this being equivalent to a load of 20 kg applied over the area of an average footstep, and being substantially less than the load imposed by an adult standing or stepping on the mat. The intermediate elements used in the switchmats of the invention form an electrical contact between the two metal sheets when the mat is compressed and are sufficiently sturdy to support the load-bearing sheet when under substantial overload, e.g. at least five times the normal load to which the mat is subjected, thereby preventing the resiliently compressible, elastomeric, non-conductive material from being subjected to severe strain. The switchmat additionally comprises a safety switch in accordance with the invention so that, when the overload is sufficiently high to damage or deform the metal sheets or intermediate elements, the restraining means of the safety switch will break thereby allowing the bridging member to spring towards its relaxed mode completing an electrical path between the metal plates causing the switchmat to failsafe.

The load-bearing sheet used in such a switchmat is substantially rigid, i.e. it has at the most limited flexibility under normal use and may be substantially non-deformable. Most metal sheets of moderate area, e.g. 1 m$^2$, will be subject to slight bowing when a heavy load, e.g. the weight of a pedestrian, is applied to the middle of the sheet unless the whole area of sheet is adequately supported. In preferred switchmats a limited amount of flexibility or bowing may be allowed since this will increase the sensitivity of the central areas of the switchmat. Such flexibility is not essential and the mode of operation of the switchmat preferably relies upon compression of the non-conductive material separating the metal sheets. The second metal sheet is preferably non-deformable under the operating conditions either by virtue of its own thickness and strength or by the use of additional support means, e.g. a reinforcing plate, or the surface to which the switchmat is applied.

The term "load-bearing" used herein means that the load-bearing metal sheet contributes less than 50% of the deformation necessary to complete the electrical contact. That is, at least 50% of the deformation is caused by compression of the resiliently compressible, non-conductive material. Preferably, at least 75% of the deformation occurs in this non-conductive material and most preferably at least 90 to 95% of the deformation occurs in the resiliently compressible, non-conductive material.

In one construction of a switchmat in accordance with the invention the intermediate elements comprise protrusions which protrude from the surface of one or both of the metal sheets. The protrusions are preferably arranged at regular intervals over the whole area of the metal sheet and may be formed by punching indentations in the sheet from its outside surface. The protrusions are raised to a height and are of sufficient number such that, when the mat is loaded, the upper metal sheet is supported on the lower metal sheet by the protrusions thereby preventing the non-conductive material from being compressed to the point where damage occurs.

In accordance with a further construction, the intermediate elements take the form of inserts of electrically conductive material which are positioned between the two metal sheets. These inserts may conveniently comprise metal spheres such as ball bearings or other conveniently shaped particles such as barrel-shaped bodies of metal or resin which has been made conducting by the incorporation of conductive particles such as of metal. Such elements need not be welded or adhered to one of the two metal sheets but each element may be conveniently confined to a desired area by forming a closed cell between the metal sheets with portions of compressible non-conductive elastomeric material.

In practice it has been found that good, reliable electric contact between the intermediate elements and metal sheet is obtained when the intermediate elements have a curved profile which is presented towards the metal sheet.

BRIEF DESCRIPTION OF DRAWINGS

The invention will now be described with reference to the accompanying drawings, in which:

FIG. 1 represents a perspective view, partly in section, of a portion of a switchmat in accordance with the invention, FIG. 2 represents a plan view of the switchmat of FIG. 1 with the top metal sheet removed, FIG. 3 represents a perspective view of a gasket suitable for use in the switchmat of FIGS. 1 and 2, FIG. 4 represents a perspective view, partly in section, of a portion of a further switchmat in accordance with the invention, FIG. 5 represents a perspective view of a strip gasket suitable for use in a switchmat.

Referring to FIGS. 1 and 2, the switchmat comprises a foundation metal plate 1, for example 2 mm thick aluminum, having a series of protrusions 4 at regular intervals throughout its area. Protrusions may conveniently be formed by punching indentations from beneath and may be raised to a height of about 3 to 4 mm above the surface of metal plate 1. Around the perimeter of the foundation plate 1 are fixed strips 5 of compressible non-conductive material such as strips of closed cell foamed neoprene rubber 1.5 cm wide×0.45 cm thick. If desired, flanges 3 may be provided along one or more of the sides or edges of plate 1 for fixing the switchmat to the floor. A top plate 2 is fixed to strips 5 of the non-conductive material. Top plate 2 may comprise 2 mm base thickness aluminum "treadplate" which has a raised 5-bar pattern embossed upon its upper surface and is intended to act as the walking surface for a pedestrian. The switchmat is designed to work at very low voltages, thus electrical connections may be made directly respectively to the two plates 1 and 2 which are exposed to the user. The switchmat will be sensitive to loads less than 20 kg, this being sufficient to compress strips 5 and permit contact between the protrusions 4 and the top plate 2, and will therefore easily detect the pressure exerted by a pedestrian's foot. The use of a 2 mm base thickness "treadplate" renders the mat resistant to damage, and overloads are accommodated by carrying the weight of the top plate and its load on the protrusions 4. By ensuring that protrusions are provided immediately adjacent to the edges, total edge sensitivity is achieved. It is readily possible for the protrusions to be formed in top plate 2 instead of bottom plate, or in both plates 1 and 2 without interfering with the operation of the switchmat.

Figure 6:
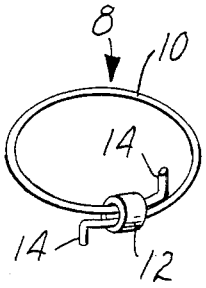
FIG. 6 represents a perspective view of a compressed bridging member in accordance with the invention.

The switchmats may be constructed of materials other than aluminum sheets or plates, for example, in the interests of hygiene, the food industry may require the use of stainless steel. The metal sheets may be constructed of any of the conductive metals or combination of metals commonly available in the engineering industry. The practical advantages of aluminum, availability in convenient sizes, lightness, cost, pleasing appearance without painting and sufficient strength, make it a convenient and desirable material in most cases. It is well known that aluminum readily forms a layer of oxide upon its surface, which inhibits further corrosion. This oxide is also a good insulator but this apparent drawback in the electrical properties may readily be overcome by shaping the intermediate elements to rupture the oxide layer.

The construction of the switchmat described with reference to FIGS. 1 and 2 above, provides a sturdy and reliable switchmat of moderate size which may be used in an industrial environment, which is not susceptible to significant contamination by liquids.

If a large switchmat area is required, for example, the span of the top plate is greater than 400 mm, the weight of the plate may cause it to sag in the middle. In order to avoid unintentional contact between conductors it is desirable to introduce additional supports of compressible non-conductive material, such as foamed neoprene strips, at intervals of about 300 mm to sufficiently support the top plates.

It has been found that, when the metal plates are aluminum the protrusions should be sufficiently pointed at their apex to enable them to pierce the oxide layer on the surface of the plates when contact is made. In practice, the punching of rounded indentations from the opposite side of the sheet provides protrusions having the desired contact points. To further increase the reliability, the protrusions should be placed at intervals such that the weight of the pedestrian's foot at any point, exerts enough pressure on the point to ensure good electrical connection. It has been found that spacings of between 50 and 150 mm, preferably 60 to 120 mm, are satisfactory for the aluminum sheets described above, with the most satisfactory performance being achieved at 75 mm. Above 120 mm a reduction of sensitivity becomes apparent when a load is placed at the mid-point between contacts, the sensitivity rapidly decreasing when spacings of 150 mm are exceeded. If the spacing of the protrusions is too close on the aluminum sheet the individual contact pressure of each protrusion may not be sufficient to pierce the oxide layer.

The use of a closed cell foamed neoprene rubber strip around the perimeter of the plates as a compressible non-conductive material provides the interior of the switchmat with some protection against contaminants. Suitable closed cell foam neoprene strip is available from C. B. Frost & Company Limited under the Trade Mark "Neontrice". The neoprene strip may be affixed to both metal plates with an oil and water resistant adhesive, e.g. a vinyl adhesive such as that commercially available from 3M United Kingdom PLC under the Trade Mark "Scotchgrip". However, the inevitable movement in the switchmat as it is loaded and unloaded may cause "breathing" through small gaps in the edge seal. According to one embodiment of the invention each protrusion is further protected with a gasket 50 of closed cell neoprene rubber in the form of a square or disc of material with a hole 15 in the center to accommodate the protrusion. An example of a circular gasket 50 is shown in FIG. 3. Typical dimensions for circular gasket 50 are 25 mm diameter with a central hole 51 of 5 mm diameter and a wall 52 thickness equal to that of strips 5. Other shapes may be used providing with width of the wall protecting the protrusion is sufficiently thick to resist distortion and consequent failure. The use of such a gasket, which may be conveniently affixed with a contact adhesive, provides a second barrier to the ingress of contaminants to the contact area with a consequent substantial increase in reliability, and may also serve as a support for the top plate in mats with a large span.

The switchmat of FIGS. 1 and 2 additionally comprises one or more restrained bridging elements as safety switches in accordance with the invention. The compressed bridging element may readily be positioned between protrusions 4, for example, in the area identified by A in FIG. 2, preferably within a gasket of the type shown in FIG. 3.

FIG. 4 illustrates an alternative switchmat in accordance with the invention in which the intermediate elements are provided separately, and mechanical alteration of the foundation plate in order to provide protrusions 4 is avoided. FIG. 4 includes a foundation plate 1 with flanges 3, a top plate 2, and a perimeter formed of compressible strips 5, as shown in FIG. 1 and these elements are identified where appropriate by the same reference symbols used in FIG. 1. The foundation plate 1 comprises a smooth metal sheet and the intermediate elements are provided by a series of metal balls 6 which are enclosed within the inner space of gaskets 7 which are similar to those shown in FIG. 3. The diameter of balls 6 is less than the thickness of strips 5 and gasket 7, generally about 1 to 1.5 mm smaller. The internal diameter of gasket 7 is larger than the diameter of the balls 6, generally about 1.5 to 5 times larger, in order to allow balls 6 to float within cavity of gasket 7, thus presenting fresh contact surfaces from time to time and generally reducing wear. The spherical shape of balls 6 presents a high pressure contact to each plate as the switchmat is loaded, acting as a conductive bridge between two plates 1 and 2. As in the case of protrusions 4, the spacing of the ball contact points is preferably between 50 and 150 mm. Preferably balls 6 are constructed of stainless steel. Such balls are freely available in commerce in a variety of sizes.

Other shaped pieces of electrically conducting material may be used in place of balls 6, for example barrel-shaped pieces of resin (not shown) which have been made conducting by the incorporation of conductive particles. However, such bridging members must be sufficiently sturdy to carry the load presented to the top plate of the switchmat under conditions of overload.

In order to facilitate the rapid assembly of switchmats incorporating separate intermediate elements, for example balls 6, the rubber gasket may be fashioned in the form of a perforated strip 60 as illustrated in FIG. 5. Strip 60 may be formed of closed cell foam neoprene rubber, in which closely spaced holes 61 are punched. The mode of application of such a strip which may be coated wth pressure sensitive adhesive on both sides, is to lay it in strips parallel to an edge at 50 to 150 mm intervals across the foundation plate and to insert the intermediate elements into the punched holes at the desired intervals of 50 to 150 mm along the length of the strip. The plurality of holes in the strip reduces its resistance to compression by loading and thus maintains the sensitivity of the switchmat.

Exemplary dimensions for strip gaskets of the type depicted in FIG. 5 are as follows:

| | No. 1 | No. 2 |
|---|---|---|
| gasket width: | 12 mm | 19 mm |
| hole diameter: | 7 mm | 12.7 mm |

-continued

| | No. 1 | No. 2 |
|---|---|---|
| hole center to center spacing: | 25 mm | 19 mm |
| gasket thickness: | 5 mm | 5.5 mm |

These gaskets are suitable for use with intermediate elements comprising metal spheres of 4 mm diameter. The length of the strip is dependent upon the size of the switchmat to be constructed.

An alternative method of constructing a switchmat using individual intermediate elements is to lay upon the foundation plate a punched sheet or grid of elastomer having many spaces and to insert the intermediate elements into the spaces at the desired intervals. This method of construction may provide the perimeter wall of compressible material as well as the internal gaskets. However, it is important to ensure that the presence of such a large amount of elastomeric material does not increase the support given to the top plate to such an extent that the switchmat's sensitivity is impaired.

The switchmat of FIG. 4 additionally comprises at least one safety switch in accordance with the invention, such as of the construction shown in any one of FIGS. 6 to 9 described hereinafter. The compressed bridging member of the safety switch may conveniently be positioned within one of the holes in the gaskets.

In certain applications it may be necessary that the lower plate of the switchmat be totally insulated from the environment, such as when the switchmat is to be installed on a metal gantry or the like. Insulation may readily be effected by the presence of a sheet of insulating material positioned beneath the lower foundation plate. The insulating sheet may comprise plywood, plastic material or any other insulating material. The insulating sheet may be constructed to possess a high load-bearing capacity; thus the lower conducting sheet may be fashioned with less regard for its load-bearing capability as the main loading will be transmitted to the insulating sheet. In such a case, the lower conducting sheet may be thin or perforated to some extent. When perforations are used, they must be of a smaller diameter than any individual intermediate elements used for contact purposes in order to ensure that electrical contact will be effected.

Although switchmats may be made so small as to contain only one intermediate element, in practice the area of such mats will be sufficient to require a plurality of intermediate elements. Practical dimensions of switchmats of the type described above range from 100 mm wide strips up to rectangles 1.4 m$\times$1.2 m which is the size of the largest aluminum sheet currently readily available. However, large switchmats are difficult to handle and may suffer damage to transit unless reinforced and accordingly it often desirable to utilize smaller switchmats, for example 1 m$\times$1.2 m, and cover large areas of floor by laying several smaller mats edge to edge and electrically connecting them in series. The smaller mats may be handled by one person and are sufficiently rigid to need protection only at the edges during transit.

The thickness of a typical mat is about 9 mm which is similar to some domestic floor coverings and thus the mat does not present a significant trip hazard.

While the dimensions specified above have found practical utility and the mats are constructed from materials which are readily commercially available, it will be appreciated that the specific dimensions of the switchmat may be varied according to the materials used and the particular application of the mat. In general, it has been found that the height of the intermediate elements, either in the form of protrusions or independent elements, such as balls, should represent from 25 to 95% of the thickness of the elastomer separating the metal sheets when in its relaxed mode. Preferably the height of the intermediate elements represents 70 to 80% of this thickness.

The electrical system connected to the switchmats may be of any desired type requiring a "make" contact at low voltage, for example, a 5 volt system controlling T.T.L. logic circuits, or a 12 volt relay may be directly connected to the mat. When the metal conductors are directly accessible by the user, it is essential that the voltage present upon the mats be low, and that suitable grounding precautions be taken. The electrical conducting wires may conveniently be affixed to the metal plates with screws or rivets and commonly a double connection is made to each plate so that the four-wire system with continuity loops may be employed. An example of a control system commercially available for use with switchmats is the "Safety Switchmat System" control marketed by 3M United Kingdom PLC.

It is essential that the switchmats remain reliable throughout their life particularly when they are required to act as a safety device in industrial locations. The switchmats have been rigorously tested to determine their performance. Satisfactory electrical performance is considered to be a resistance of less than 1 ohm across the mat when contact is made.

Switchmats of the invention have withstood the impact of 75 kg at 2.5 m/sec transmitted through a circular steel plate approximately 45 $cm^2$ for 1000 cycles at the same point upon the mat without significant loss of performance, although the aluminum tread plate was visibly marked. With the impact speed reduced to a few centimeters per second, a closer representation to a foot step, in excess of 4,000 cycles produced no visible or measurable effect upon the mat's performance.

Another switchmat in accordance with the invention which possessed internal gaskets around the intermedate elements, was submerged in ordinary tap water and operated from time to time. After a continuous period of 16 days it failed due to the ingress of water.

To test the shear strength between the aluminum top plate and foundation plate of a switchmat, a motor car was driven onto the switchmat and stopped with its rear driven wheels upon the mat. The car was then accelerated away. No deterioration in the appearance or performance of the mat was noted.

Switchmats constructed using metal balls as the intermediate elements as illustrated in FIG. 4 have exhibited a sensitivity for a 1 $m^2$ mat of 10 to 20, the loads being distributed over a circular area of about 45 $cm^2$ to simulate a footstep. This sensitivity is more than adequate to detect the step of a pedestrian on any portion of the mat.

While indentations and ball bearings have been used individually in the examples, these intermediate elements may be combined as necessary in one mat.

The mats although designed for use on an essentially horizontal floor, will function equally well at any angle to the horizontal, up to and including inversion.

FIG. 6 illustrates a restrained bridging member 8 of a safety switch in accordance with the invention. Bridging member 8 comprises a helical spring 10 of 1.3 turn of spring wire such that, in the relaxed mode, ends 14 of spring 10 are separated by a distance between the two conductive plates of a switchmat, for example, a distance greater than the height of the strips of non-conductive compressible material of FIGS. 1, 2 and 4. The spring 10 is restrained in a compressed mode by a frangible bead or collar 12 which may be formed of glass, ceramic material or brittle plastic material. Ends 14 of spring 10 are each passed through frangible collar 12 in opposite directions so that they lie side by side within collar 12. While in the collar 12, ends 14 are relaxed in the plane of the turn of spring 10 but under compression in the sense that, in the relaxed state, they would move in opposite directions. Frangible collar 12 is prevented from moving along the length of the spring wire by friction, the curvature and the bend adjacent ends 14 of spring 10.

Figure 11:
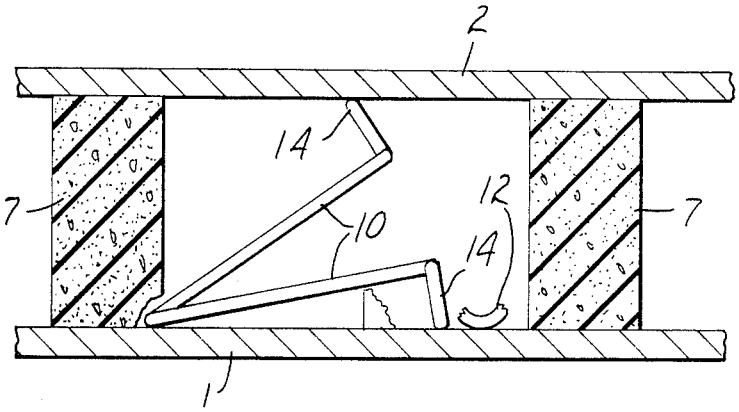
FIG. 11 shows a side enlarged view, with parts cut away to show detail, of a portion of a switchmat with the bridging member unrestrained.

In use, at least one of the ends 14 of restrained bridging member 8 is not able to contact at least one of the two conductors. Upon application of a load upon the switchmat sufficient to sandwich collar 12 between the conductors, collar 12 is shattered, ends 14 of spring 10 will no longer be constrained and will spring apart as depicted in FIG. 11 to form an electrical bridge between conductors 1 and 2 thereby actuating the switch. The bridging member will continue to bridge the conductors thereafter even when the compression force is removed.

Figure 10A:
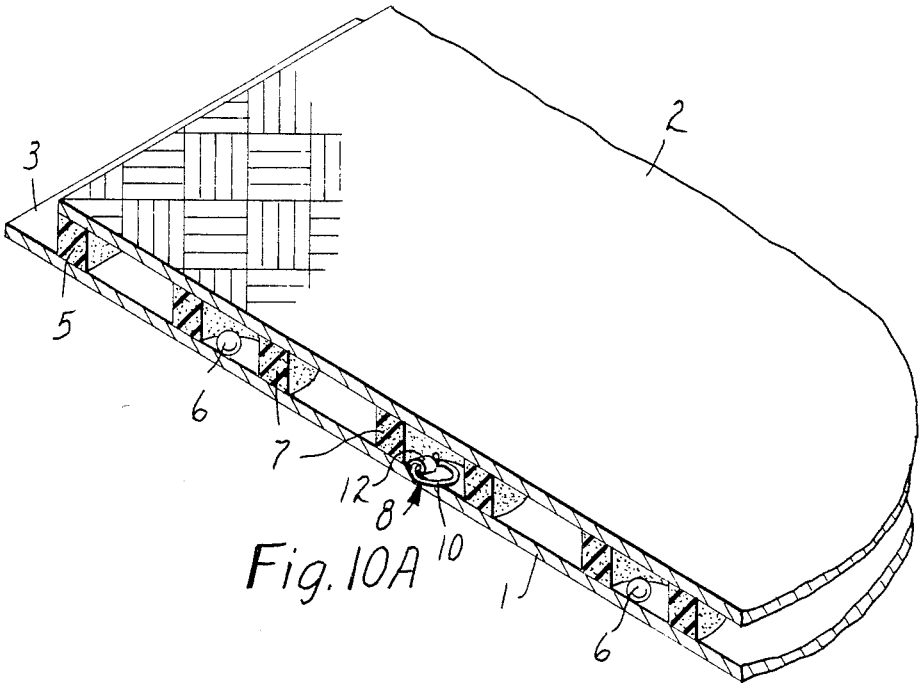
FIGS. 10A and 10B represent perspective views, with parts cut away to show detail, of a switchmat containing a bridging member respectively in a restrained and unrestrained position.
Figure 10B:
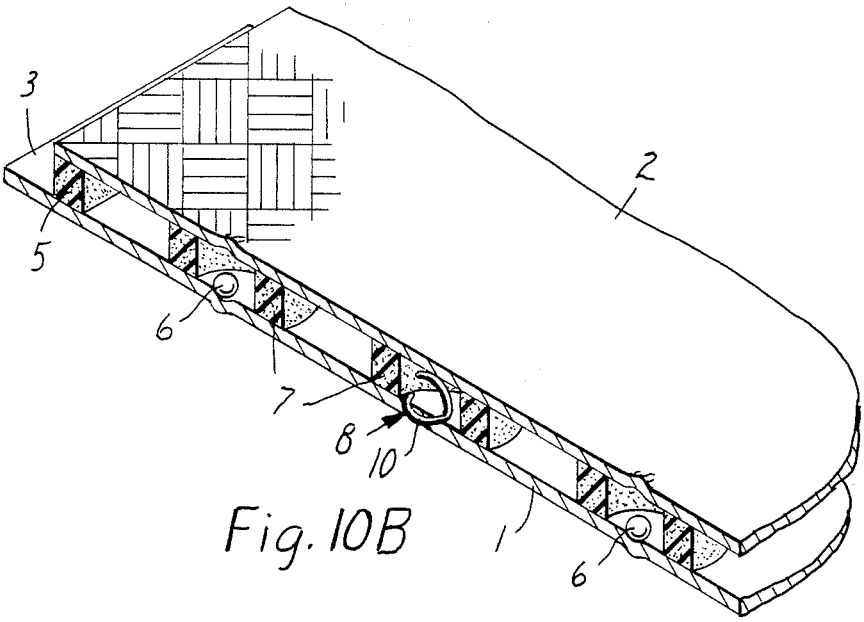

For example, in the switchmat shown in FIG. 4, a bridging member 8 of the type depicted in FIG. 6 may take the place of one of metal balls 6, as shown in FIGS. 10A with bridging member 8 restrained and FIG. 10B with bridging member 8 unrestrained. In normal operation, balls 6 may make slight indentations in aluminum plates 1 or 2 upon application of a load, e.g. the weight of a pedestrian, but insufficient to allow the gap between plates 1 and 2 to close to the point where frangible collar 12 is broken. In conditions of severe overload, balls 6 may be driven into aluminum plates 1 and 2 to such an extent that normal operational sensitivity is impaired, i.e. the weight of a person would not close the switch. In such circumstances, the gap between plates 1 and 2 will be closed to such an extent that frangible collar 12 would be shattered thereby releasing ends 14 of the bridging member to spring the restrained bridging member 8 to permanently short-circuit aluminum plates 1 and 2, rendering the switch failsafe.

In practice it is often desirable to ensure that a restrained bridging member used in a switch of the invention has two or more ball switches in close proximity in order to prevent accidental breakage of the restraining means caused by a sudden load, for example, should an operator drop a tool.

Figure 7:
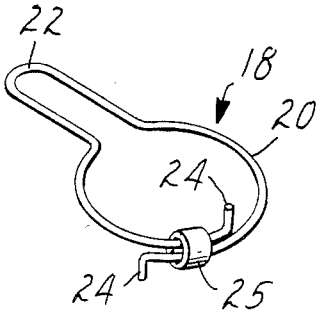
FIG. 7 represents perspective view of a modified form of a compressed bridging member of the invention.

In a typical switchmat, which has 6 mm separations between its plates, a helical spring bridging switch is contained in an elastomeric ring having a 12.5 mm inside diameter. Spring 20, as depicted in FIG. 7, has an 11 mm outside diameter, a small attachment loop 22 5 mm long by 2 mm wide extending from the main circular shape, and, in the relaxed mode, ends 24 separate at least 7 mm. The helix is made from 0.45 mm diameter spring wire with ends 14 bent upwards and downwards to give "spikes" of approximately 1 mm. A suitable glass bead for use with this helix is in the form of a tube 3 mm long, 2 mm outside diameter, with a wall thickness of 0.35 mm. Such a bead requires a load of approximately 1.3 kg radially applied to cause it to shatter.

It will be apparent that the bridging member described above will only be suitable for operation in a horizontal plane unless it is secured to one of the conductors. There is a remote possibility that a particle of shattered restraining means may lodge between the helix and one of the conductors preventing conduction between the conductors. FIG. 7 illustrates a modified bridging member 18 in which the basic helix shape of the spring 20 is distorted by the addition of a reverse bend to provide loop 22 Ends 24 are bent upwards and downwards respectively by a length slightly greater than the thickness of the wall of collar 25. Loop 22 is used as a fixing lug and may be secured to one of the conductors, maintaining the plane of constrained spring 20 parallel to the surface of the conductor. This may be conveniently achieved in the switchmat illustrated in FIGS. 1, 2 and 4 by inserting the lug under the edge of the insulating strips 5 so that the coil of the spring lies flat against the surface of one of the conductors. This enables the switch to be operated in any attitude. Ends 24 of the spring wire are preferably sharpened so that good metal to metal contact is ensured upon actuation of the switch. Furthermore, the length of the bent portions is sufficient to prevent particles of shattered restraining means from disabling the switch.

Figure 8A:
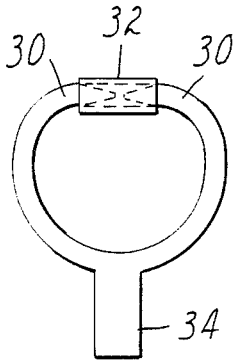
FIGS. 8A to 8D represent plan view of further variants of bridging members in accordance withthe invention, FIGS. 8AA to 8DD represent side views respectively of the further variants of the bridging members depicted in FIGS. 8A to 8D with the restraining collars removed to permit deployment of the contact ends.
Figure 8A:
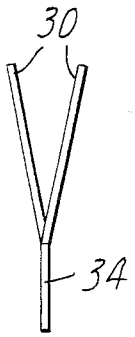
Figure 8B:
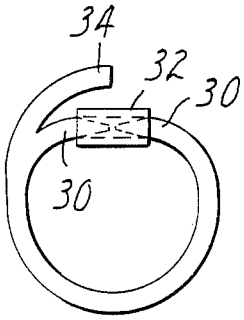
Figure 8B:
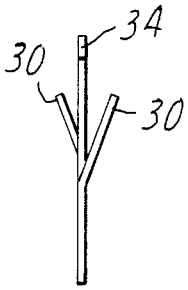
Figure 8C:
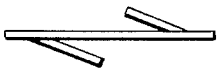
Figure 8C:
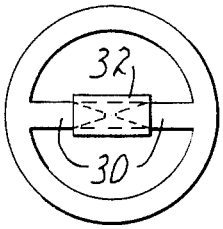
Figure 8D:
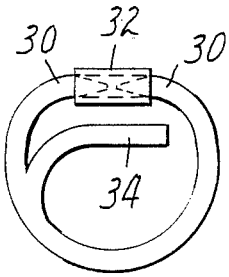
Figure 8D:
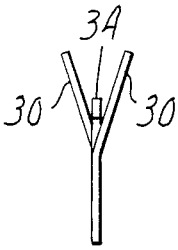

FIGS. 8A to 8D illustrate further variants of restrained bridging members suitable for use in the invention which may be punched from metal sheet, e.g. phosphor bronze, beryllium copper strip, etc., formed into shape, and, if required, tempered in a kiln. Each of these designs include two ends 30 which are held in the restrained mode in a horizontal plane by a frangible collar 32. Upon breaking collar 32, ends 30 spring apart to contact with each conductor. FIGS. 8AA to 8DD illustrate the unrestrained bridging members respectively depicted in FIGS. 8A to 8D. The bridging members may include a lug 34 for securing the bridging member within the switch. Alternatively, the bridging member may be secured by a portion of its circumference. The bridging members illustrated in FIGS. 8A to 8D have the advantage that they may be mass produced cheaply by use of an automatic mechanical press.

It is not necessary for ends 30 of the bridging members to overlap and each may be inserted into the end of the restaining means, for example a glass bead, resting against each other in the center of the aperture of the bead. The bead may be prevented from moving by tapering ends 30.

Figure 9A:
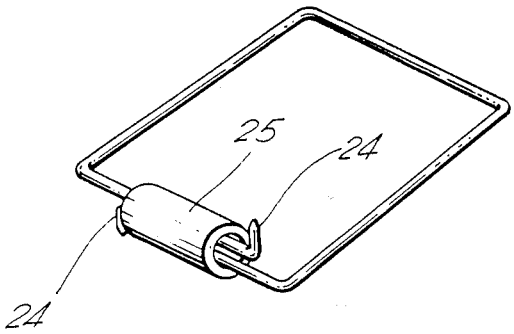
FIGS. 9A and 9B represent perspective views of a further variant of a bridging member in accordance with the invention.
Figure 9B:
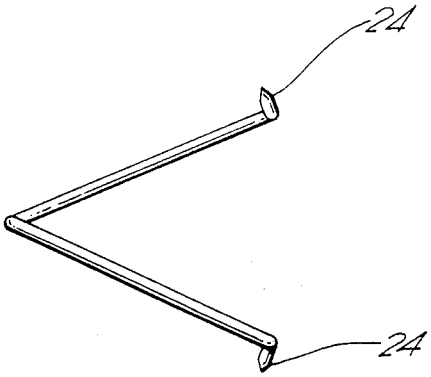

FIGS. 9A and 9B represent a further bridging element for use in the invention in the compressed and relaxed modes respectively, the same reference numerals being used as in FIG. 7. The bridging element is in the form of a wire spring having a substantially rectangular form and dimensioned to provide a broad base to prevent twisting of the bridging member in use.

In addition to its use in switchmats the electrical safety switch may be incorporated into a fire alarm circuit, the switch being mounted vertically on a wall or the like and being operated by a person compressing the switch by hand. In such a construction the insulating material separating the two conductors comprises a relatively soft compressible material, such as a foamed elastomer. Upon shattering the restraining means the switch will complete the alarm circuit which could not be reset except by replacement of the bridging means.

The electrical switch of the invention may also be used as a "limit of travel" switch by mounting it upon a framework of a machine which has moving parts such as a crane. The switch is positioned such that if unacceptable or unauthorised movement occurs the switch is compressed thereby breaking the restraining means and activating the switch which would complete an alarm or disabling circuit.

In order to impart protection against metallic swarf which may short circuit the plates of the mat, the lower plate may be made larger than the top plate, e.g. by 25 mm and the top plate would be modified by placing over it a load bearing plate of the same size as the enlarged lower plate. Thus, the additional top plate is electrically insulated from the upper conducting plate, for example by a plastics spacer, the edges of the mat are then sealed with an insulating material such as foam rubber. The lower plate may have flanges to allow mechanical fixing to the floor.

I claim:

1. An improved pressure actuatable switchmat comprising first and second electrically conductive members separated by non-conductive material, said conductive members being positioned with respect to each other to make electrical contact therebetween when said switchmat is subjected to an actuation load, the improvement comprising including in the switchmat an overload switch comprising an electrically conductive bridging member having a first end and a second end connected by a spring member held under compression by a frangible restraining means capable of releasing said spring member to its relaxed state upon being subjected to a predetermined overload which breaks said frangible means and causes at least one of said ends to move to provide a completed electrically conductive path between said conductive members.

2. The switchmat of claim 1 wherein the spring member comprises at least one turn of spring wire and said first and said second ends are bent respectively up and down at right angles to the plane of the turn of wire.

3. The switchmat of claim 1 wherein said bridging member is a helical spring obtained by pressing from a sheet material.

4. The switchmat of claim 1 wherein said bridging member includes a lug formed in the spring member which is used to secure the bridging means within the switchmat.

5. The switchmat of claim 1 wherein said frangible restraining means comprises a frangible collar or bead.

6. The switchmat of claim 1 comprising a first conductive sheet separated from a load-bearing sheet having an electrically conductive surface by resiliently compressible, non-conductive material, and a plurality of conductive intermediate elements positioned between the conductive sheets such that, when a load is applied to the load-bearing metal sheet, the non-conductive material compresses and one or more of the intermediate elements establishes a conductive path between the metal sheets.

7. The switchmat of claim 6 wherein said intermediate elements comprise protrusions on the surface of at least one of said conductive sheets.

8. The switchmat of claim 6 wherein said intermediate elements comprise conductive spheres.

9. The switchmat of claim 6 wherein the height of each intermediate element represents from 25% to 95% of the thickness of the compressible, non-conductive material when in its relaxed mode and each intermediate element is surrounded by a gasket of compressible, non-conductive material affixed to at least one of said conductive sheets.

10. A restrained bridging member suitable for use in the switchmat of claim 1 comprising a first and a second end connected by an electrically conductive spring member whch is held in a compressed state by a frangible restraining means.

11. The bridge member of claim 10 wherein said spring member comprises at least one turn of spring wire and said first and ends are bent respectively up and down at right angles to the plane of the turn of spring wire.

12. The bridging member of claim 10 wherein said spring member is a helical spring obtained by pressing from a sheet material.

13. The bridging member of claim 10 wherein said frangible restraining means comprises a collar or bead.

14. An electrical switch comprising two electrical conductors in spaced relationship and a restrained bridging member according to claim 10 positioned therebetween such that, when said restraining means is broken by a predetermined overload applied to the switch, at least one end of the bridging member moves to complete a conductive path between said conductors which conductive path is maintained after removal of said overload.

* * * * *

UNITED STATES PATENT AND TRADEMARK OFFICE

CERTIFICATE OF CORRECTION

PATENT NO. : 4,554,424

DATED : November 19, 1986

INVENTOR(S) : RONALD G. TYE

It is certified that error appears in the above-identified patent and that said Letters Patent is hereby corrected as shown below:

In the Specification:

Col. 1, line 39, "3,828,277" should read --3,825,277--.

Col. 3, line 44, "that mat may" should read --the mat may--.

Col. 4, line 45, "such as" should read --or--.

Col. 5, line 12, "withthe" should read --with the--.

Col. 5, line 31, "Protrusions may" should read --Protursions 4 may--.

Col. 5, line 59, "bottom plate, or" should read --bottom plate 1, or--.

Col. 6, line 60, "a hole 15" should read --a hole 51--.

In the Claims:

Claim 11, line 1, "The bridge member" should read --The bridging member--.

Signed and Sealed this

*Eighteenth* Day of *March 1986*

[SEAL]

*Attest:*

DONALD J. QUIGG

*Attesting Officer*

*Commissioner of Patents and Trademarks*